US007520712B2

(12) United States Patent
Bruns et al.

(10) Patent No.: US 7,520,712 B2
(45) Date of Patent: Apr. 21, 2009

(54) DEVICE FOR HOLDING A LOAD ON A LOAD SUPPORT OF AN INDUSTRIAL TRUCK

(75) Inventors: Rainer Bruns, Hamburg (DE); Jan-Henning Wille, Munich (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 444 days.

(21) Appl. No.: 11/144,290

(22) Filed: Jun. 3, 2005

(65) Prior Publication Data

US 2005/0279583 A1 Dec. 22, 2005

(30) Foreign Application Priority Data

Jun. 4, 2004 (DE) ..... 10 2004 027 444

(51) Int. Cl.
*B66F 9/18* (2006.01)

(52) U.S. Cl. ..... 414/685; 187/237

(58) Field of Classification Search ..... 414/462, 414/466, 607, 655; 187/237, 238
See application file for complete search history.

(56) References Cited

U.S. PATENT DOCUMENTS

| | | | | |
|---|---|---|---|---|
| 2,281,012 | A | 4/1942 | Sears | 214/60 |
| 2,566,863 | A * | 9/1951 | Voigt | 414/622 |
| 4,116,349 | A | 9/1978 | Durham | 214/654 |
| 4,640,080 | A * | 2/1987 | Wright | 53/449 |
| 5,035,104 | A * | 7/1991 | Helling et al. | 53/441 |
| 6,604,634 | B2 * | 8/2003 | Su | 206/524.8 |
| 7,213,684 | B2 * | 5/2007 | Bruns et al. | 187/237 |
| 2006/0033350 | A1 * | 2/2006 | Besch | 294/119.3 |

FOREIGN PATENT DOCUMENTS

| | | |
|---|---|---|
| DE | 412989 | 4/1925 |
| DE | 29 29 621 | 2/1981 |
| DE | 94 18 354.6 | 1/1995 |
| EP | 0 467 210 A1 | 7/1991 |
| GB | 651714 | 11/1946 |
| GB | 2 250 267 A | 10/1990 |
| WO | 91/05719 | 5/1991 |
| WO | 02/14206 | 2/2002 |

OTHER PUBLICATIONS

GB-Z Material Handling News, Oct. 1962, p. 4.

* cited by examiner

*Primary Examiner*—Charles A Fox
(74) *Attorney, Agent, or Firm*—Vidas, Arrett & Steinkraus, P.A.

(57) ABSTRACT

Device for holding a load on a load support of an industrial truck with the following characteristics:

Figure 1:
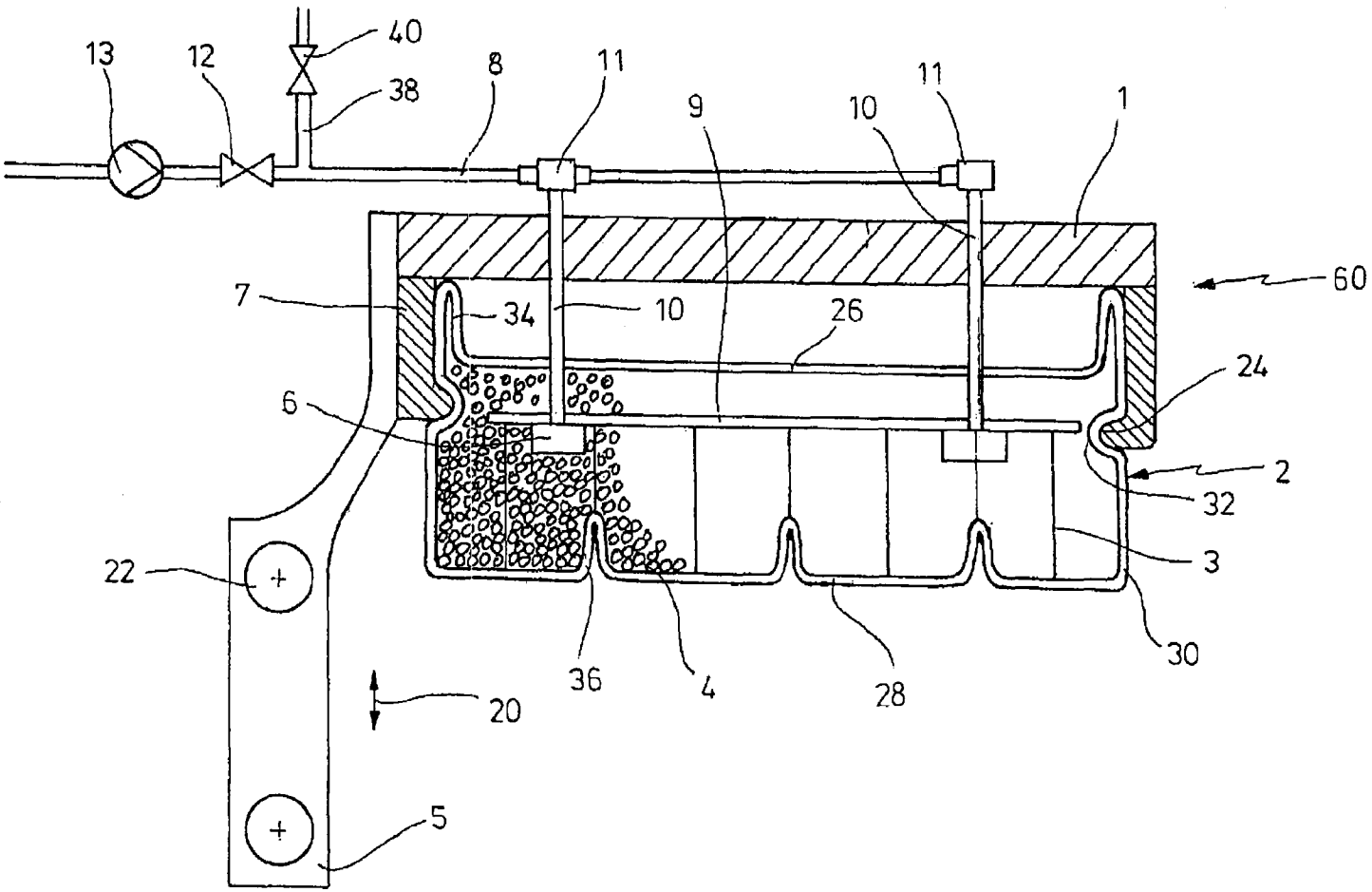

a support device on a lifting scaffold of the industrial truck, adjustable in its height by a shifting drive, extending approximately horizontally above the load support, at least one sack-shaped container, made of flexible, air-impermeable material, which is hanged up on the support device and which is filled with granular material, wherein the flexible material and the granular material are constituted such that the bottom side of the container adapts itself to the surface contour of the load, when the container is lowered onto the load, and an aspirating device, connectable with the interior of the container, for generating a negative pressure in the container.

14 Claims, 2 Drawing Sheets

DEVICE FOR HOLDING A LOAD ON A LOAD SUPPORT OF AN INDUSTRIAL TRUCK

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The main purpose of industrial trucks is to pick up, transport and set down loads,. These loads are elevated by a load support such as, a load supporting fork. On industrial trucks without a stacking-in function, the load support lifts as much of a load that can be transported. On industrial trucks with stacking-in function, the load support has an adjustable height relative to a lifting scaffold.

Transporting objects having a high centre of gravity or a low weight with a small horizontal area when standing-up tend to fall down from the load support, particularly when the industrial truck drives over uneven ground or through curves. For this reason, load holders have already become known which exert a pushing force against the transporting object from above, in order to prevent any falling down of the transported object from the pallet or of the pallet from the load support. From DL 9418354 U1 or EP 467210 B2, a load holding device with a horizontal plate has become known, which can be moved in the vertical direction by a second lifting device, independently of the lifting of the load support, and which is pushed onto the transporting load from above. However this is difficult when transporting objects of different heights because they can not be secured on the load support at the same time.

The prior art has proposed attempted solutions to this problem. From DL 412989 C or WO 214206 A2 it is known to mount several load holders side by side on the support device. Through this, it is possible to clamp fast several transporting objects of different height, which are situated side by side on the load support. However, it is not possible to sufficiently clamp fast transported objects of different heights which are situated in the longitudinal direction (fork direction) in front to each other.

From GB 2250267 A or from DE 2929621 C2 it is known to dispose several plates side by side or back to back on one load support, which are movable with respect to each other. It is a disadvantage that the height differences between the individual transporting objects have to be in relatively narrow limits. Furthermore, with several load holders or plates, respectively, the construction is limited by weight and complexity of the construction with respect to their number and the extension of the transporting objects.

This invention is based on the objective to provide a device for holding a load on a load support of an industrial truck by which transporting objects of significantly differing heights can be fixed on the load support.

BRIEF SUMMARY OF THE INVENTION

In the device according to the invention, a support device, with an adjustable height, extends in a substantially horizontal direction above the load support. When the industrial truck has a lifting scaffold, the support device is preferably also guided on the lifting scaffold, preferably in an independent fashion with respect to the load support. It is also conceivable, however, to affect the mounting of the load support such that the support device can be guided, adjustable in the height, on the mounting device of the load support. In the case that there is no lifting scaffold, the support device is also guided on the mounting device for the load support, or on a scaffold for its own, along which the support device can be guided, movable in the height, with the aid of a shifting drive.

On the support device, at least one sack-shaped container, made from an air-impermeable flexible material, is attached or hanged up, respectively, in a recumbent position. The container is filled with a granular material. The sack-like container can be formed by a sheet, which consists of plastic material, metal, rubber or rubberised fabric and which can have a multilayer structure, the outer side of the outer layer having a corresponding coating for protection against wear and damages at least on the bottom side of the container, whereas an inner layer provides for air-tightness. The sack-shaped container is filled with granular material, e.g. a granulate, the size and shape of the particles being selected such that the sack can adapt itself very well to the contour of the upper side of the load. As the particles, balls or irregularly shaped particles from various materials can be selected, from metal, plastic material, elastomers, rubber, ceramics or wood, for instance.

An aspirating device is connected to the interior of the container, which generates a negative pressure in the container. The negative pressure causes the particles to be pressed against each other, and frictional forces prevent easy movement of the particles with respect to each other. particles are quasi frozen, and therefore they maintain the shape of the container they have been positioned against. The container which is fixed in this manner transfers the forces which are necessary for holding the load to the support device by positive fit. The positive fit of the container enables force transmission in the vertical as well as in the horizontal direction. Through this, the load picked up by the industrial truck can be safely transported.

It is not necessary to use a closed container mounted on the support device, a sack-like membrane can be used instead. The sack-like membrane is sealingly mounted on the support device, on part of which is a support plate. In at least one embodiment of the invention the container has a fold or bead on its perimeter, which is supportingly received in a horizontal, channel-shaped recess of a frame of the support device. The invention can adapt to the contours of the transported objects in more than one manner. First the bottom side of the wall of the container can be flexible. Second the granular material is inherently able to flow in the lateral or upward direction. In this manner it can maintain the upper side of the container such that it can give way, in an upwards direction with the aid of suitable folds or the like.

As the wall of the container must be relatively yielding, there is the danger that the wall buckles out towards the downside. Therefore, one form of realisation of the invention provides that holding means are provided in the container, on which the bottom side of the sack-like container is hanged up. For instance, the holding means can be formed by vertical ribbons, which are connected to a holding element which is horizontally disposed in the container. According to one form of realisation of the invention, the holding element can be held by at least one pipe which is sealingly guided into the container and which is connected with the aspirating device.

The end of the aspirating device in the container suitably has a screen, which prevents aspiration of the granular material.

The individual functions of an industrial truck are controlled by a suitable control device. The latter can also control the functions of the load holding device according to the invention. Alternatively, a separate control device can also be provided. It can, at least partially, automatically control the operation of the load holding device according to the actuation of the load support. For instance, the load holding device can be lowered onto the transporting object when the load support performs a lift after picking up a load or has performed it. Conventionally, a load is picked up first and then it is brought into a desired height, before the truck drives to a desired place. When the lifting of the load is completed, the activation of the load fixation can take place. The fixing of the load can take place also as a first step, for instance with a double deck high-lift truck, in order to prevent falling off of the load upon lifting. According to a further form of realisation, the control device can stop the lowering of the load when a sensor which measures the push-force on the load generates an output signal which exceeds a predetermined value.

The aspirating device can be switched off automatically by the control device, when a pressure sensor detects that the pressure in the container falls below a predetermined value.

The invention will be hereinafter explained in more detail by means of a realisation example, which is represented in a drawing.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated FIG. 1 schematically shows a load holding device according to the invention in a cross section.

Figure 2:
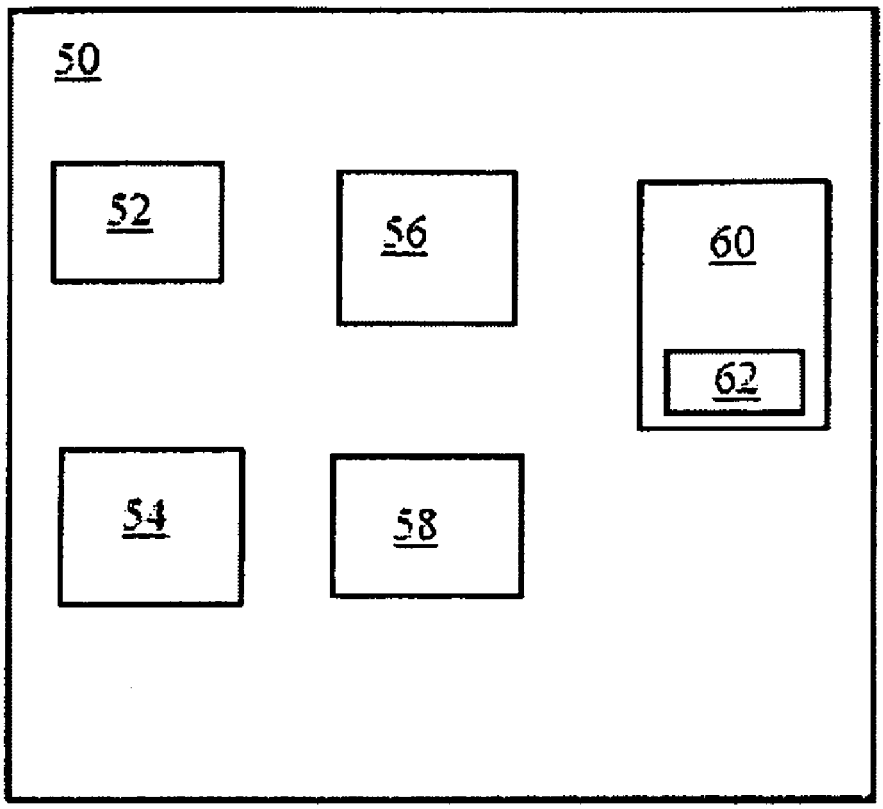

FIG. 2 schematically shows an industrial truck and components thereof.

A holding plate 1 is mounted on a guiding part 5. The guiding part 5 is guided movable in its height, in a manner independent from a load support 52, in a lifting scaffold of an industrial truck 50, and can be actuated by a not shown lifting drive. The lifting drive contains a hydraulic or pneumatic lifting cylinder, a shaft drive, a thread spindle or the like, for instance. The height shifting is intended to be indicated by the double arrow 20. Besides to this, rolls 22 are indicated, which are guided in corresponding guiding rails of the lifting scaffold 56.

On the holding plate 1, a frame 7 is mounted to be horizontally running around. The frame can have a circular or a rectangular contour. The dimension and the contour correspond about to the standing-up area of transporting objects on standardised pallets. Other contours and sizes are also conceivable, however. The wall of the frame 7 has a bead 24, projecting towards the inside, on the inside of the bottom side.

A sack-like container 2 has an upper wall 26, a bottom wall 28 and a circulatory side wall 30. The thickness of the walls can be equal or different. Altogether, they are made of a relatively flexible material, which may have elastomeric properties, too. The sheet forming the walls can be a single-layer or a multilayer one. In each case, it must have an air-impermeable layer. The outer side can have a wear-resistant coating.

The upper region of the side walls 30 is received inside the frame 7, the bead 24 forming a corresponding notch 32 in the side wall 30. The upper part of the side walls 30 can be joined with the inner side of the frame 7 in an appropriate manner, by gluing for instance. The upper wall 26 forms a circulating seam 34 with the side wall 30, such that the upper wall 26 takes a distance to the holding plate 1.

The bottom wall 28 has upward-directed foldings 36 at distances.

A pump 13 is driven by a not shown electric motor and is connected with an aspiration line 8 above the holding plate 1 via a check valve 12. Via connecting parts 11, the aspiration line 8 is in connection with two aspiration pipes 10, which are sealingly guided into the interior of the container 2 across the upper wall 26. However, the sealing must be such that it does not interfere with any lifting or lowering of the upper wall 26. Anyway, this would not be the case when a yielding line was guided into the interior of the container 2 instead of a rigid pipe 10.

In the present case, a horizontal element 9 is attached to the pipes 10, which is supported on a screen 6, which is mounted on the bottom end of the aspiration pipe 10. On the horizontal holding element 9, ribbons 3 are attached at distances, which are connected with the inner side of the bottom wall 28. Through this, the bottom wall 28 is held and prevented from buckling or sinking through.

It is also conceivable to connect the ribbons 3 with the upper wall 26. Before the check valve 12 with respect to the aspirating direction, a branching 38 is connected to the aspiration line 8, in which a switching valve 40 is seated. The switching valve 40 connects the aspiration line 8 with the atmosphere, when it is in the opening position.

A granulate 4 is filled into the container 2. The particles of the granulate 4 are selected such in their size and shape that the container 2 can adapt itself as well as possible to the contour of a load, which is disposed below the load holding device 60 on the load support 52. The particles can be balls or irregularly shaped grains, which may consist of quite various materials.

In the following, the principle of operation of the load holding device 60 will be explained.

When the operator of the industrial truck 50, on which there is the load holding device 60 shown in FIG. 1, has picked up the load, the operator actuates the lowering of the load holding device 60. The beginning of the lowering movement can be controlled automatically in that a control device 58 couples the actuation of the load holding device 60 with the actuation of the load support 52. Preferably, the support device 60 is lowered first, so that the load is securely fixed before it is lifted by the load support 52. When the load is being lifted, the support device 60 has to be moved synchronously with the load support 52. This is possible without any problem when the scaffold on which the support device 60 is guided, is fixed on the load support 52. After a short or even longer lift of the load support 52, the lowering can be initiated when this lift is ended.

The container 2 is lowered onto the load from the upside, in this the bottom side or bottom wall 28 of the container 2 adopts the contour of the load, because the granulate 4 is freely movable inside the container 2. The end of the lowering movement can also be initiated automatically, in that a pressure sensor 62 detects when the push force of the load holding device 60 upon the load reaches a predetermined value.

After the end of the lowering process, the pump 13 is brought into operation and the switching valve 40 is closed. Through this, the air is sucked off from the container 2, the check valve 12 preventing that any air current in the opposite direction takes place when the pump 13 is switched off. The switching on and off of the pump 13 can be manually controlled or even automatically. For instance, the pump can be brought into operation when the lowering movement of the load holding device 60 is ended. It can be switched off as soon as the air pressure in the container 2 falls below a predetermined value.

The aspiration of the air has the effect that the particles of the granulate 4 are pressed against each other and that frictional forces prevent any easy movement of the particles with respect to each other. This results in fixing (quasi a freezing in) of the momentaneous form of the container 2. The thus fixed container transfers forces, which are necessary for holding the load, in a form-fitting manner. This is valid for the transmission of the forces between the load and the container 2 as well as for the transmission of the forces between the container 2 and the load holding plate 1. The load holding plate 1 and the frame 7 are formed such that a form fitting is created between the container 2 and the load holding plate 1 or the frame 7, respectively, which allows for force transmission in the vertical as well as in the horizontal direction.

When the industrial truck 50 is to set down the load, its load support 52 is lowered first. Next the lifting device moves up the load holding device 60. In this manner, the load is released and can be set down. Next, the switching valve 40 is opened. Through this valve, air from the atmosphere can flow into the container 2. The inflowing air causes the frictional engagement between the particles of the granulate to diminish and the container 2 adopts its original form again.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

This completes the description of the preferred and alternate embodiments of the invention. Those skilled in the art may recognize other equivalents to the specific embodiment described herein which equivalents are intended to be encompassed by the claims attached hereto.

What is claimed is:

1. Device for holding a load on a load support of an industrial truck comprising a support device on a lifting scaffold of the industrial truck, the support device being adjustable in height by a shifting drive, the support device extending approximately horizontally above the load support, at least one container made of flexible, air-impermeable material, the at least one container being hung on the support device and filled with granular material, wherein the flexible material and the granular material are constituted such that the bottom side of the container adapts itself to the surface contour of the load, when the container is lowered onto the load, and an aspirating device, connectable with the interior of the container, for generating a negative pressure in the container.

2. Device according to claim 1, characterised in that the container has a fold or bead on its perimeter, which is supportedly received in a horizontal, channel-shaped recess of a frame of the support device.

3. Device according to claim 1, characterised in that holding means are provided in the container, on which the bottom side of the container is hung.

4. Device according to claim 1, further comprising a holding means mounted on a pipe of the aspirating device, the pipe is sealingly guided into the container from above.

5. Device according to claim 4, characterised in that the holding means have a horizontal holding element, on which holding ribbons are attached in distances.

6. Device according to claim 1, characterised in that the bottom side of the container have foldings at distances.

7. Device according to claim 1, characterised in that the outer side of the bottom side of the container has a protective wear resistant layer.

8. Device according to claim 1, characterised in that the end of the aspirating device which is in the container has a screen the mesh size of which is smaller than the particles of the granular material.

9. Device according to claim 1, further comprising a control device for the load holding device constructed and arranged to actuates the shifting drive, when the load support performs a predetermined lift after picking up a load.

10. Device according to claim 1, further comprising a control device for the load holding device constructed and arranged to stops the lowering movement of the support device, when a sensor measuring the pushing force onto the load of the container creates an output signal which exceeds a predetermined value.

11. Device according to claim 1, characterised in that the aspirating device has a pump driven by an electric motor, which is connected to the interior of the container via a check valve.

12. Device according to claim 11, further comprising a control device constructed and arranged to switches on the electric motor, when the lowering process of the support device is ended.

13. Device according to claim 11, further comprising a control device constructed and arranged to switches off the electric motor, when a pressure sensor measures a predetermined negative pressure in the container.

14. Device according to claim 1, characterised in that between the aspirating device and the container a branch is connected with a line which has a switching valve for ending the negative pressure in the container.

* * * * *